US006050455A

United States Patent [19]

Soehnlen et al.

[11] Patent Number: 6,050,455

[45] Date of Patent: Apr. 18, 2000

[54] CASELESS DISPENSER CONTAINER

[75] Inventors: Gregory M. Soehnlen, N. Canton; Dale Panasewicz, Strongsville, both of Ohio

[73] Assignee: Creative Edge Design Group, Ltd., Canton, Ohio

[21] Appl. No.: 09/390,926

[22] Filed: Sep. 7, 1999

Related U.S. Application Data

[63] Continuation-in-part of application No. 09/114,244, Jun. 29, 1998.

[51] Int. Cl.[7] ..... B67D 5/06

[52] U.S. Cl. ..... 222/185.1; 222/143; 222/481.5; 222/538; 215/382; 220/675

[58] Field of Search ..... 222/185.1, 143, 222/530, 538, 481.5; 215/382; 220/669, 675; 206/504

[56] References Cited

U.S. PATENT DOCUMENTS

| | | | |
|---|---|---|---|
| 1,746,332 | 2/1930 | Barroll | 222/571 |
| 3,782,602 | 1/1974 | Page | 222/143 |
| 4,372,455 | 2/1983 | Cochran | 215/382 |
| 5,163,587 | 11/1992 | Apps et al. | 222/143 X |
| 5,375,741 | 12/1994 | Harris | 222/185.1 X |
| 5,794,818 | 8/1998 | Bromwell et al. | 222/143 |

*Primary Examiner*—Gregory L. Huson

*Attorney, Agent, or Firm*—Fay, Sharpe, Fagan, Minnich & McKee, LLP

[57] ABSTRACT

A liquid container for a comestible product such as milk or juice includes a base having a substantially planar region that slopes toward a dispensing opening. A vent opening spaced from the dispensing opening is also dimensioned for filling the container. A handle is integrally formed in the container and serves the dual purpose of a structural load transferring member and for carrying the container. Like containers can be arrayed and stacked on top of one another so that the stacked containers can be wrapped in a flexible material and the use of shipping cases eliminated.

14 Claims, 18 Drawing Sheets

SECTION A-A

SECTION B-B

SECTION D-D

SECTION E-E

SECTION C-C

CASELESS DISPENSER CONTAINER

RELATED APPLICATIONS

This is a continuation in part application of U.S. Ser. No. 09/114,244, filed Jun. 29, 1998.

BACKGROUND OF THE INVENTION

The present invention relates generally to dispenser containers, and particularly relates to a caseless dispenser container used for transporting, storing, and dispensing fluids such as dairy products.

The invention relates to a molded, thin-walled container capable of being stacked one upon a like container, allowing the containers to be stacked on a pallet and stretch-wrapped so that the containers may be conveniently stored and shipped without using returnable, disposable, or replaceable shipping cases.

Storage and shipment of containers of this type are primary concerns. For example, five gallon poly bags are presently used to store a variety of dairy products. The poly bags are shipped in a specially dimensioned case and transferred to a customized dispensing case that fits in a cooler unit. Two problems arise from these industry standards for packaging dairy products. First, the concept of shipping the product in shipping cases entails a large amount of unnecessary expense and specialized equipment. That is, the containers are stored and shipped in some form of shipping case and, accordingly, the containers are not designed with any regard to structural loading, stackability, and efficient packaging during transport. Instead, the shipping cases address these concerns of load bearing, stackability, and transport. For example, a shipping case may contain between four (4) and six (6) containers therein. Shipping cases formed of wire or plastic, corrugated boxes, or other corrugated materials provide structural support to the individual containers during shipment. The shipping cases have served this purpose for many years in the industry.

Resources, though, must be expended on the shipping cases. Unnecessary costs and labor are associated with manufacturing and storing the cases before they are loaded with the individual containers for transport. A large inventory of cases are required at the dairy facility so that filled containers can be subsequently loaded into the cases, and the shipping cases loaded on transport trailers. The shipping cases are intended to bear the structural loads during shipping and transport, and are dimensioned so that they efficiently fit within, for example, a tractor trailer.

The end user removes the individual containers from the shipping cases. Again, additional labor is required to unload the containers from the shipping cases. Floor space is also required to store the empty shipping cases until they are returned to the manufacturing facility.

Larger volume dispenser containers, for example on the order of three (3) and five (5) gallon dispenser containers, are in wide use today. When storing fluid products, the well-known polybag is used. Although the container, i.e., the polybag, is itself lightweight and conforms to its environment due to the inherent flexibility of the container, it has other drawbacks. One example, is that a dispensing tube must be secured to the polybag, and the bag and tube properly oriented for receipt into a special case or conform to the dimensions of the cooler unit in which it is stored during dispensing. It is difficult to orient the tube used with the bag with the case inserted into the cooler unit.

Additional concerns are associated with dispensing the fluid product from the container. Adequate venting and access to the venting arrangement are required. In some instances it may be desired to stack containers on top of one another during use. This compounds the concerns with access to the vent cap and the dispensing tube in known arrangements.

It is also important to assure maximum drainage of the fluid product from each container.

It would, therefore, be desirable to provide a caseless dispenser container that provides for stackability and eliminates the need for separate shipping cases. It would be further desirable to provide a container structure that is a ready-fit for dispensing systems and provides adequate venting and maximum drainage of product from the container.

SUMMARY OF THE INVENTION

The present invention is directed to a new and improved caseless dispenser container which eliminates the need for separate shipping cases and provides increased strength for stacking containers one atop another without compromising, and in fact facilitating, use at a dispensing site.

According to the present invention, the caseless dispensing container includes a six-sided or parallelepiped housing that forms a hollow fluid cavity or chamber. An integrally formed handle is formed in the container. Additionally, a first or fill opening is provided in the container for filling the cavity with fluid and also serving as a vent opening during dispensing. A second or dispensing opening is provided in a second face adjacent a bottom wall of the container with a spout oriented for fluid dispensing. At least one structural support rib is provided in the sidewalls to add strength to the container and allow containers to be stacked one atop another.

According to another aspect of the invention, the lower surface of the container cavity is sloped toward the dispensing opening for maximizing drainage.

According to another aspect of the invention, a structural support rib is conformed to simultaneously serve as a tube storage slot for holding a dispensing tube in place during shipment and handling.

According to yet another aspect of the invention, integrally formed support feet of the container are specially configured to increase the support area over which vertical loads may be transferred from one container to another when disposed in stacked relation.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in the specification and illustrated in the accompanying drawings. The drawings show.

DETAILED DESCRIPTION OF THE PREFERRED EMBODIMENTS

Figure 1:
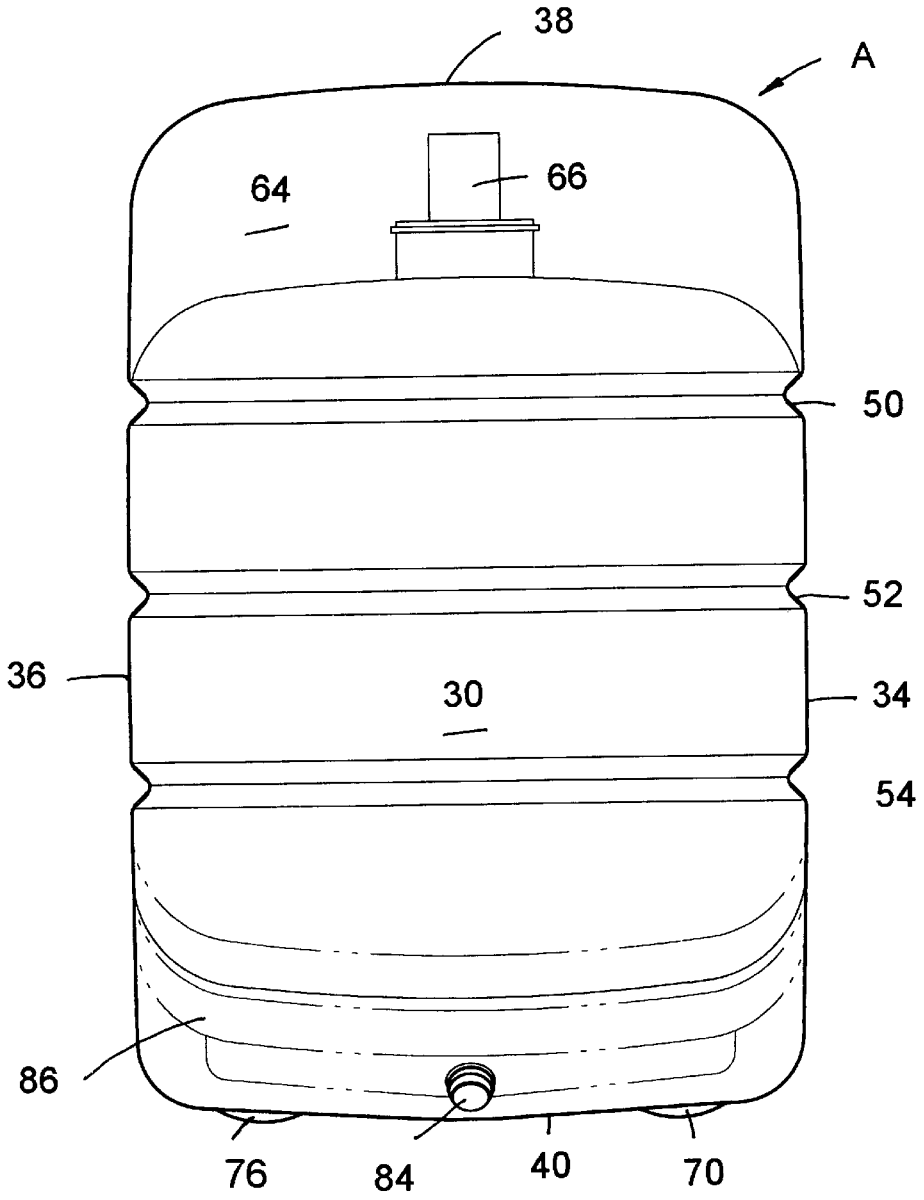
FIG. 1 is a front elevational view of a first preferred embodiment of a caseless dispensing container.

Referring now to the drawings, wherein the showings illustrate the preferred embodiments of the invention only and are not intended to limit same. The FIGURES show a caseless dispenser container A which is in the general form of a parallelepiped. The dispenser of FIGS. 1–7 is, for example, a three (3) gallon caseless dispenser container used in the dairy industry. It will be appreciated that the invention is not limited to caseless dispenser containers used in the dairy industry but that this development finds particular application in this field because of the longstanding nature of the containers and shipping procedures used without substantial change over the years. Front and rear walls 30, 32 (FIG. 2) of the caseless dispenser container are disposed in generally parallel relation, as are side walls 34, 36, and the top and bottom surfaces 38, 40. In the preferred arrangement, the walls are integrally formed together from a blow molded, thin-walled plastic defining an interior cavity that stores the fluid product ultimately dispensed therefrom. At least one stiffening rib, and as shown here, four stiffening ribs 50, 52, 54, 56 are employed for adding strength and rigidity to the structure. As perhaps best illustrated in FIG. 1, the ribs in the preferred embodiment are defined by continuous sidewall depressions, i.e., inwardly extending ribs, that extend about the entire periphery of the container in generally parallel relation about the front and rear walls 30, 32 and the sidewalls 34, 36. The strengthening ribs permit the structure to be formed from thin walls, thus achieving a reduction in the amount of plastic used relative to known containers, while still maintaining the desired strength and rigidity to stack containers one atop another as is presently achieved with separate shipping cases (stacking of the containers one atop another is best illustrated in FIG. 7). Accordingly, other strengthening rib configurations that achieve these objectives can be used without departing from the scope and intent of the subject invention. The goal of using a thin-walled structure while maintaining the ability to stack filled containers one on top another for ease of transport and storage, as well as substantial cost reductions associated with eliminating the shipping cases, is uniquely achieved with the preferred embodiment.

Figure 4:
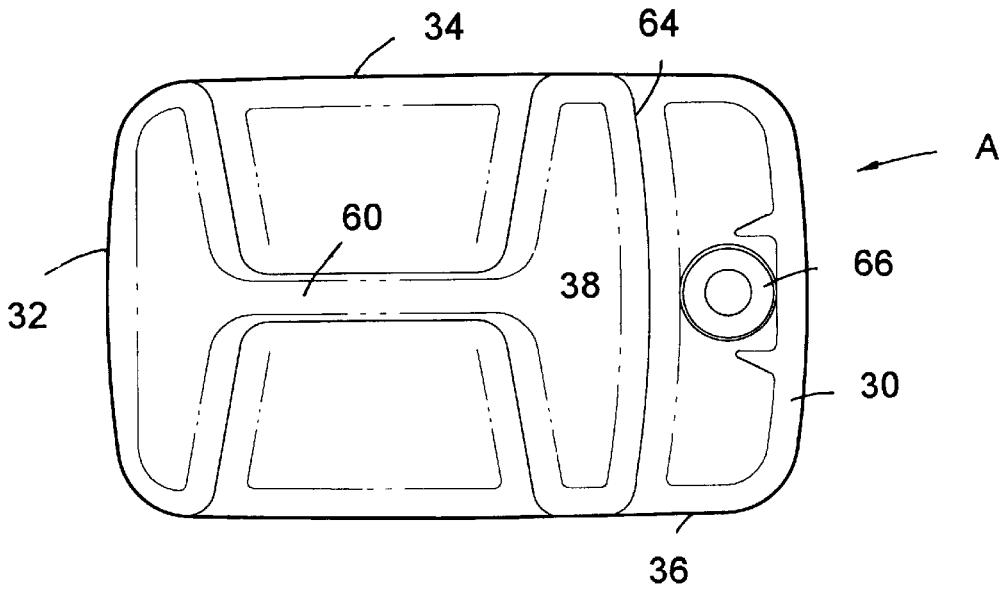
FIG. 4 is a top plan view thereof.
Figure 2:
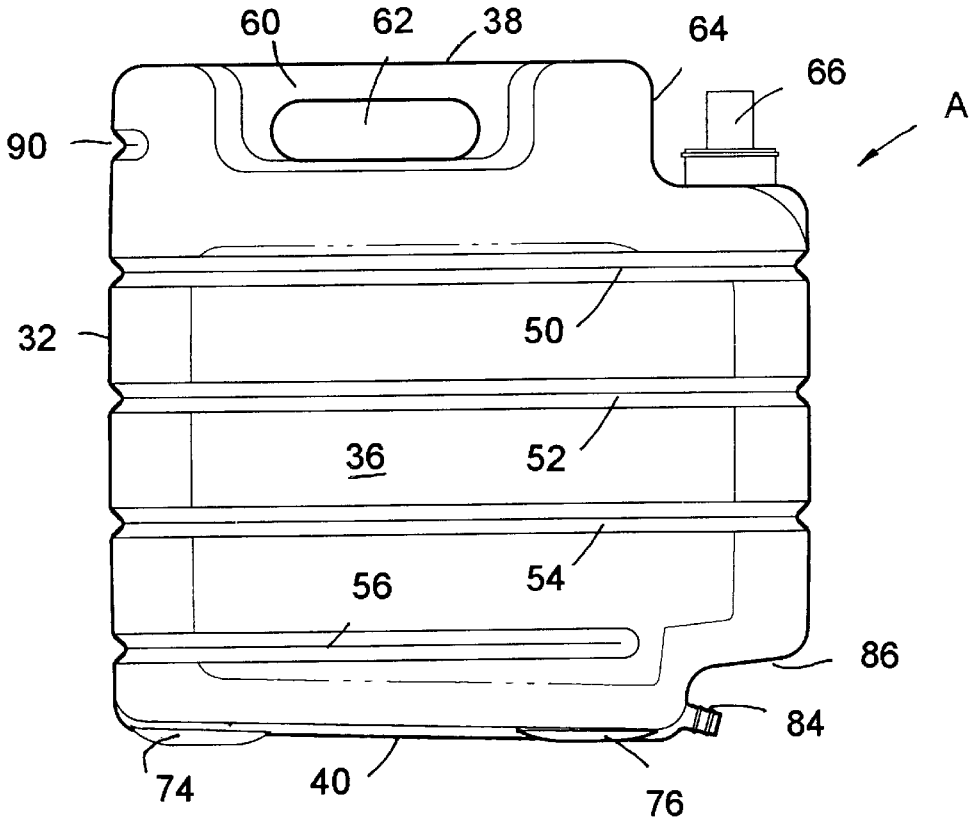
FIG. 2 is a left side elevational view thereof.

With additional reference to FIG. 2, integrally formed handle 60 is formed adjacent or as a part of the upper wall 38. Finger receiving opening 62 is defined beneath the handle and allows a user to easily grasp and handle the container. The handle is generally centered over the center of gravity of the container for ease in handling, although it will be understood that still other arrangements can be used without departing from the scope and intent of the subject invention. As seen in FIGS. 2 and 4, the upper surface of the handle 60 defines a substantial portion of the upper wall 38. This permits the downward or loading forces to be easily transferred from the upper wall to the front wall, rear wall, and the side walls of the container. Moreover, the generally H-shaped configuration (FIG. 4) provides a suitable stable platform surface for supporting the next adjacent container stacked thereon while providing an ergonomic handle. Of course, other locations for the integrally formed handle are contemplated, although the location in the top wall is convenient since its configuration can add to the desired strength and load bearing features while still providing an easily accessed and ergonomically styled handle for carrying the container.

A recess 64 is formed in the top wall 38, or disposed inwardly from the front wall 30. In the preferred arrangement, the recess 64 has a height and depth that accommodates a fill spout 66. The recess 64 is of suitable depth so that the fill spout 66 is functional and does not interfere with the stacking relationship of adjacent containers. The fill spout is of suitable diameter to allow rapid filling of the dairy product into the container. In addition, the fill opening subsequently serves as a vent opening during dispensing. Thus, it is important that the recess 64 be of sufficient depth to allow operator access to the opening to vent during dispensing.

Figure 3:
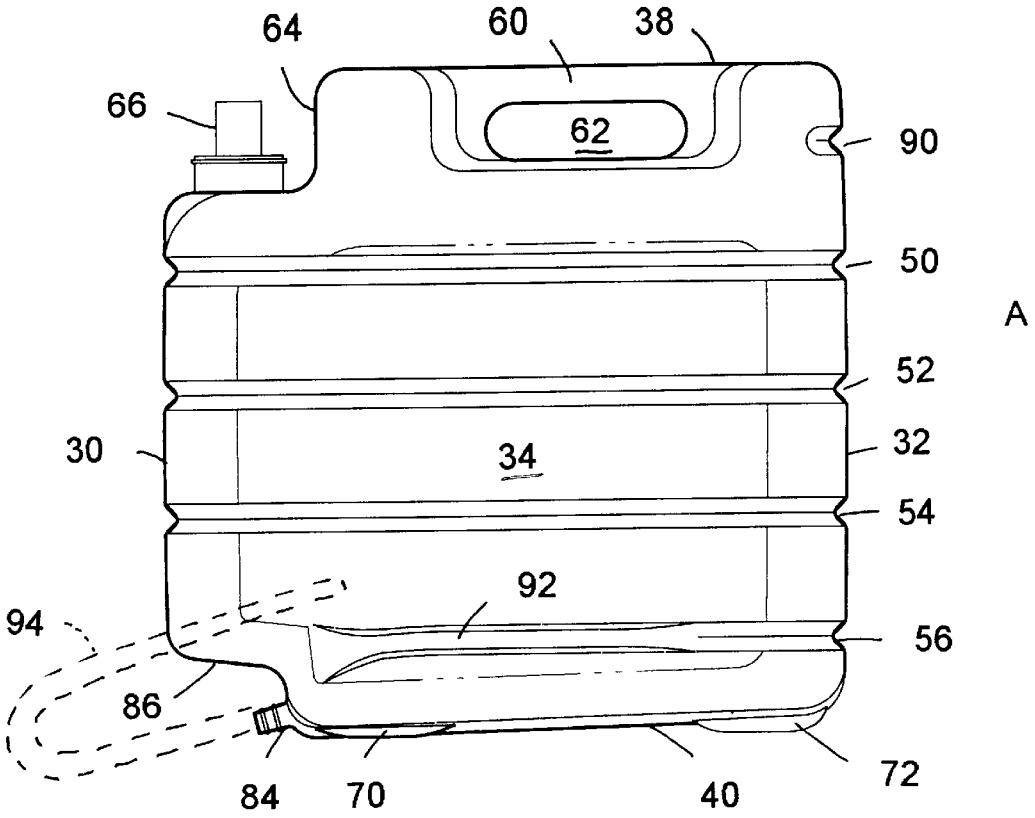
FIG. 3 is a right side elevational view thereof.
Figure 5:
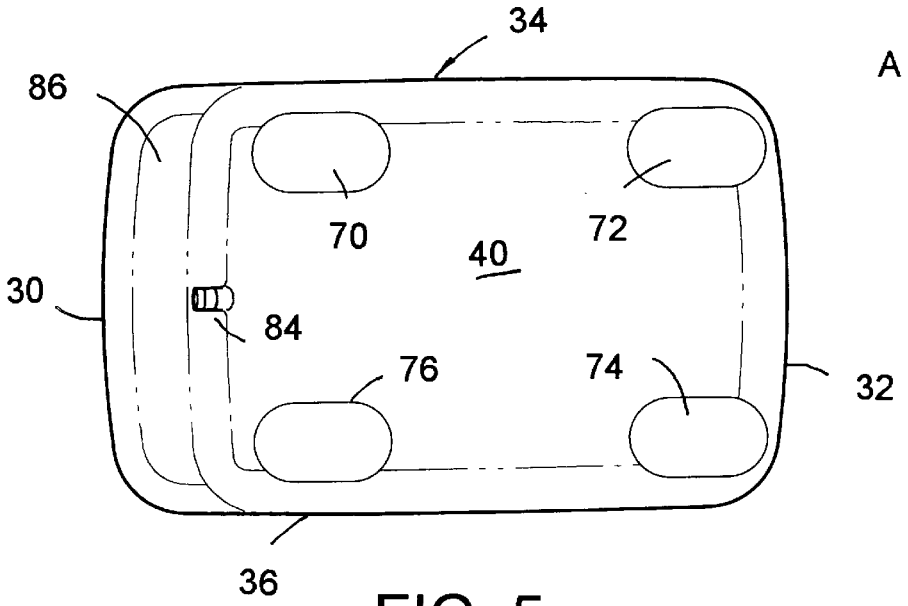
FIG. 5 is a bottom plan view thereof.

The configuration of the bottom wall 40 is particularly illustrated in FIGS. 1, 2, 3, and 5. It has a slope or incline from the rear wall 32 toward the front wall 30 (FIGS. 2 and 3). As will be appreciated, the sloping surface facilitates draining of the fluid from the cavity when it is placed on a generally horizontal surface. In addition, feet 70, 72, 74, 76 extend outwardly at spaced, corner locations of the generally planar bottom wall 40. In the preferred arrangement, the individual feet have an elongated oval configuration (FIG. 5) that provides a suitable surface area for supporting the container. In the illustrated embodiment, each of the feet has a generally domed configuration with generally planar central regions, providing a stable support for the container. The feet are also conveniently located to engage or rest on the parallel portions of the H-shaped upper wall 38 of a next adjacent container when disposed in stacked relation. This provides a column-like transfer of the weight or vertical forces from one container to another in the stacked position.

Figure 6:
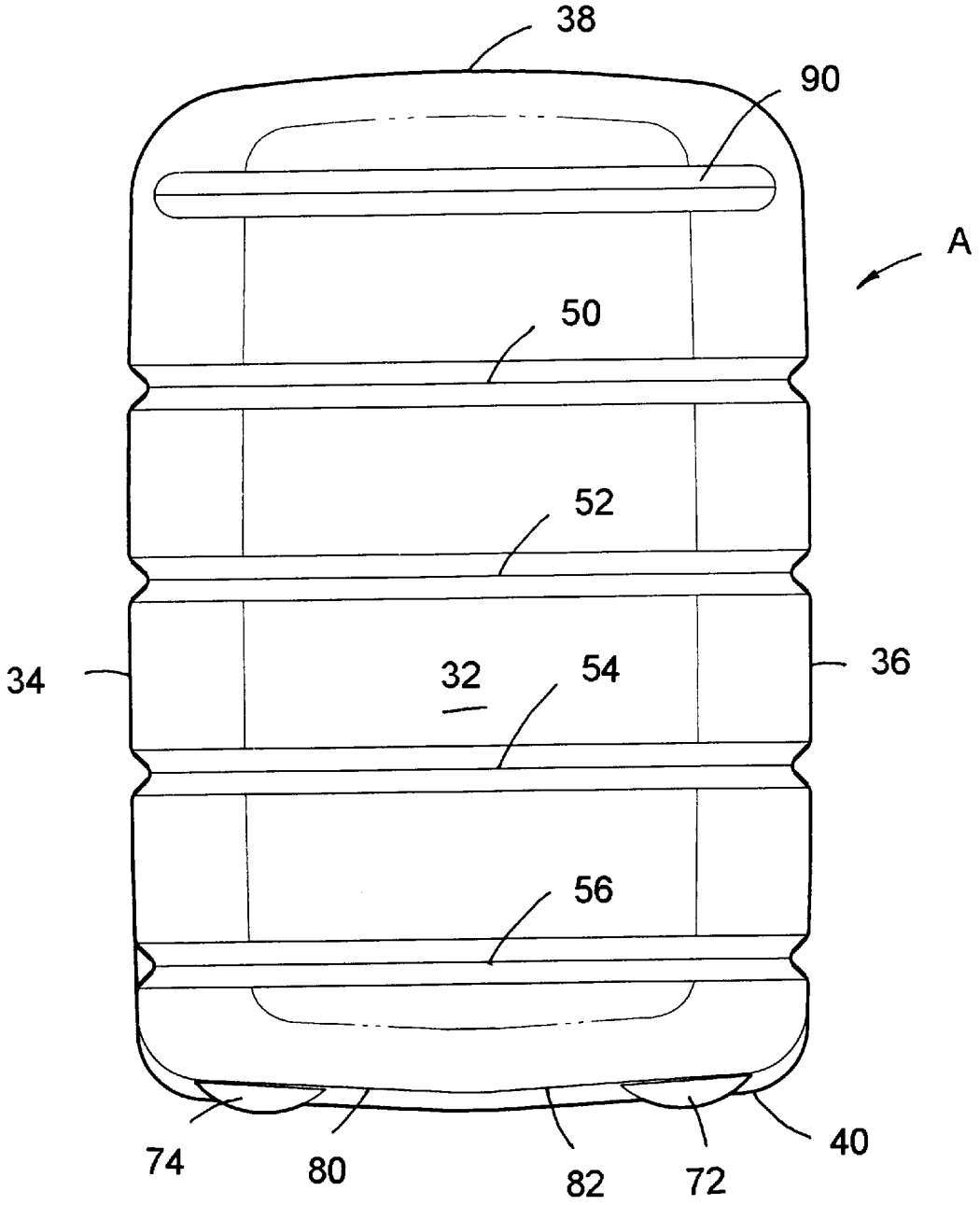
FIG. 6 is a rear elevational view thereof.
Figure 7:
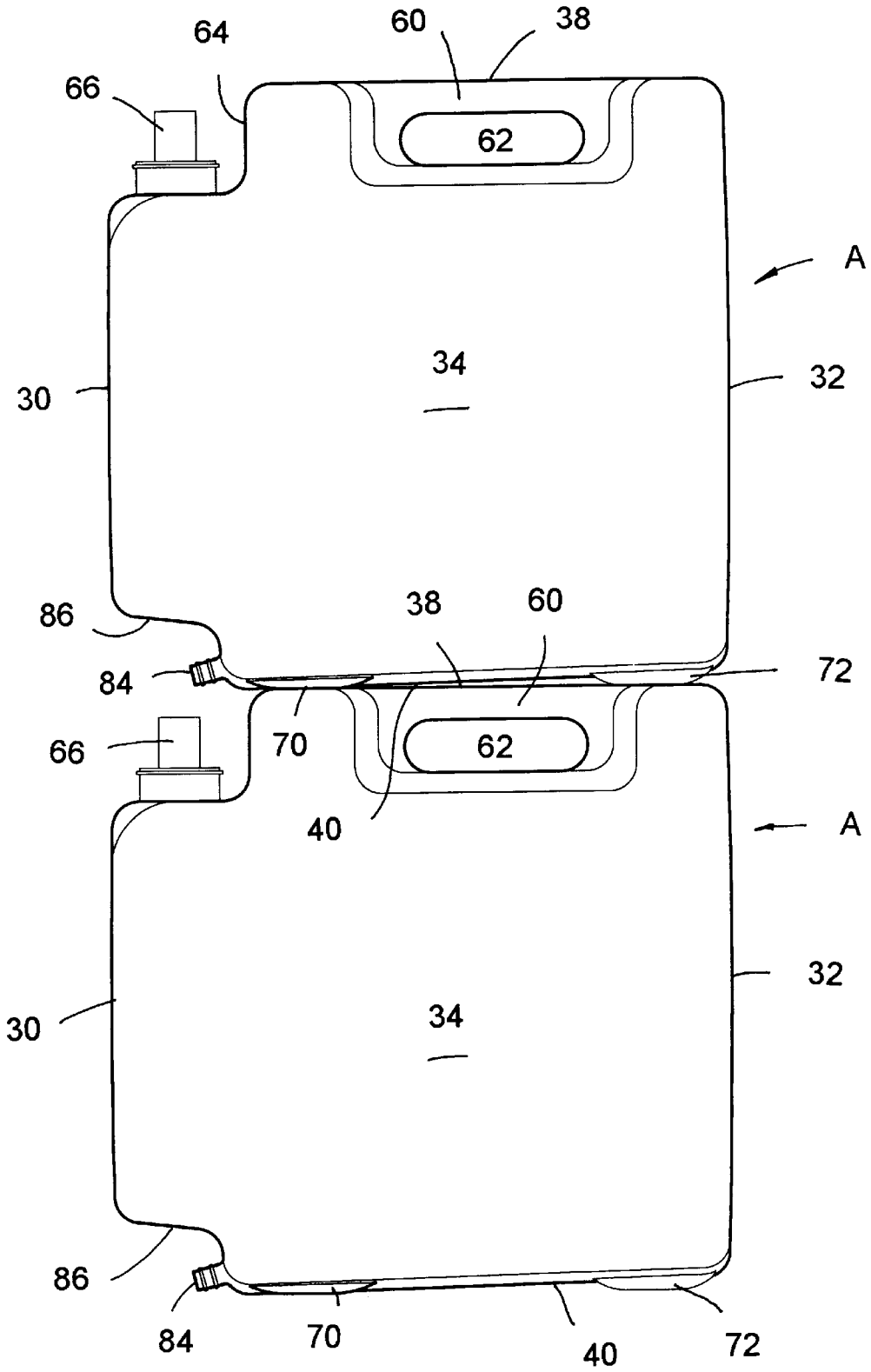
FIG. 7 is a side elevational view illustrating a pair of caseless dispenser containers in stacked relation.
Figure 8:
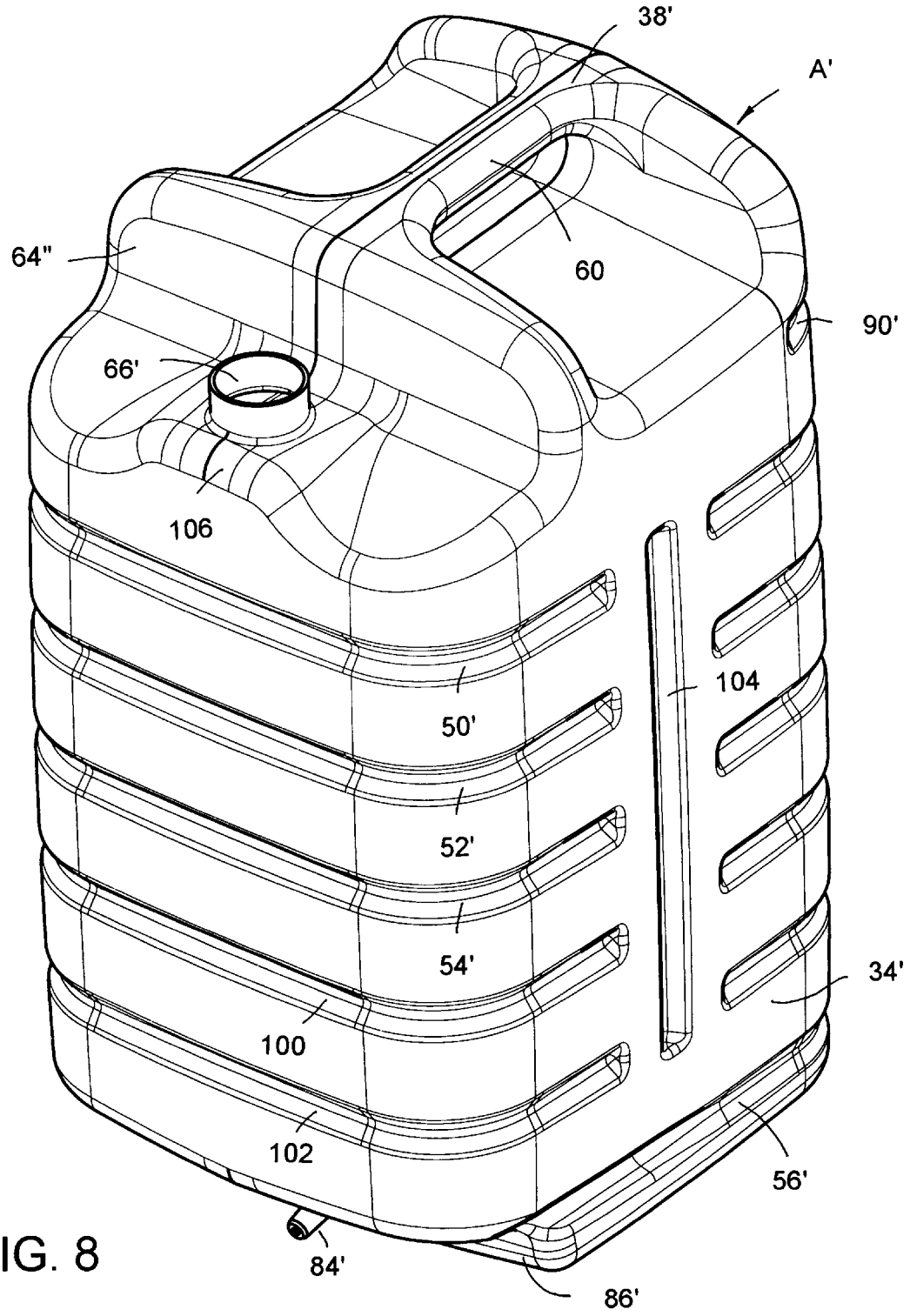
FIG. 8 is a perspective view taken generally from the top and right-hand side of a second preferred embodiment of a caseless dispenser container.
Figure 9:
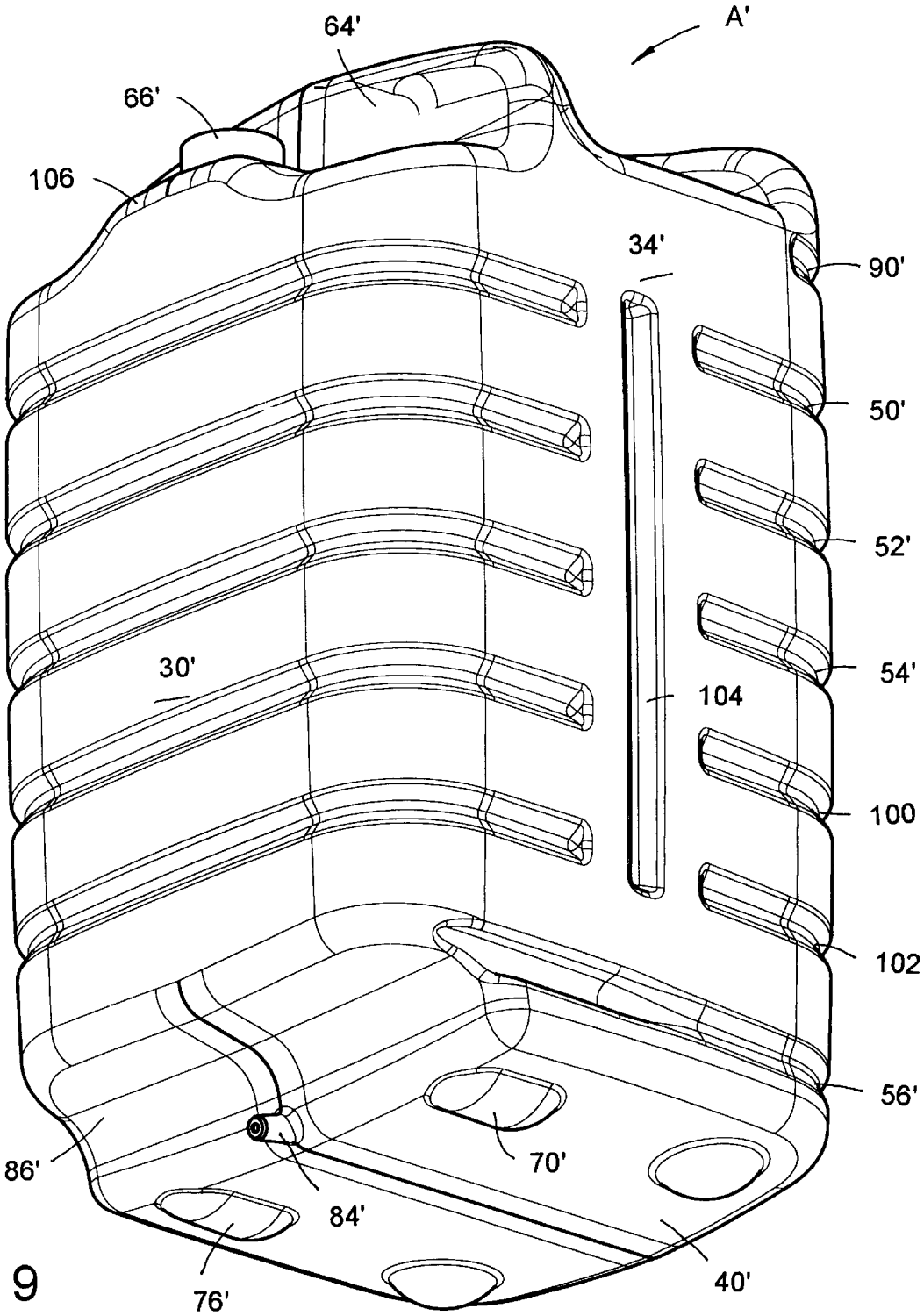
FIG. 9 is a perspective view taken generally from the bottom and right-hand side thereof.
Figure 10:
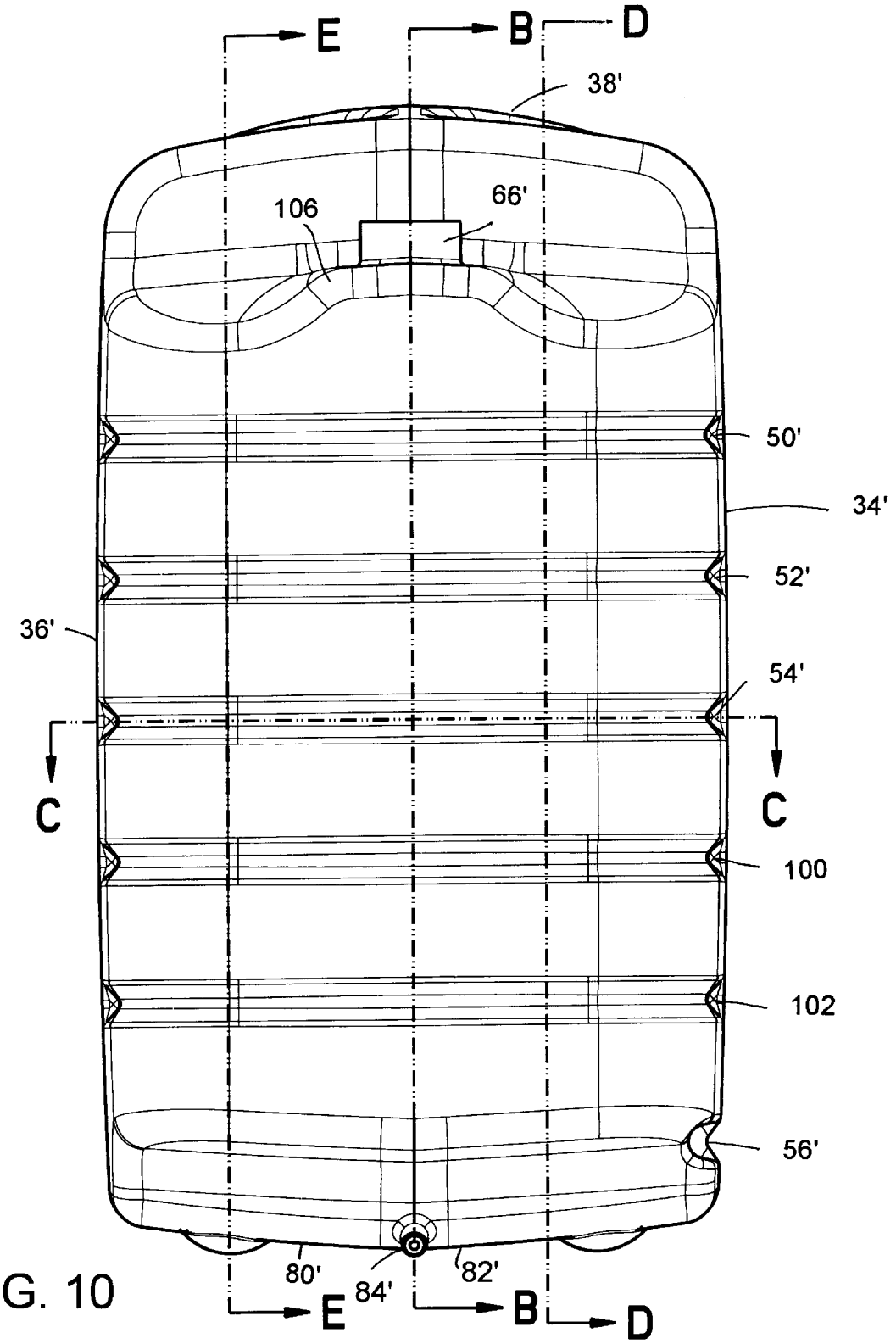
FIG. 10 is a front elevational view thereof.
Figure 11:
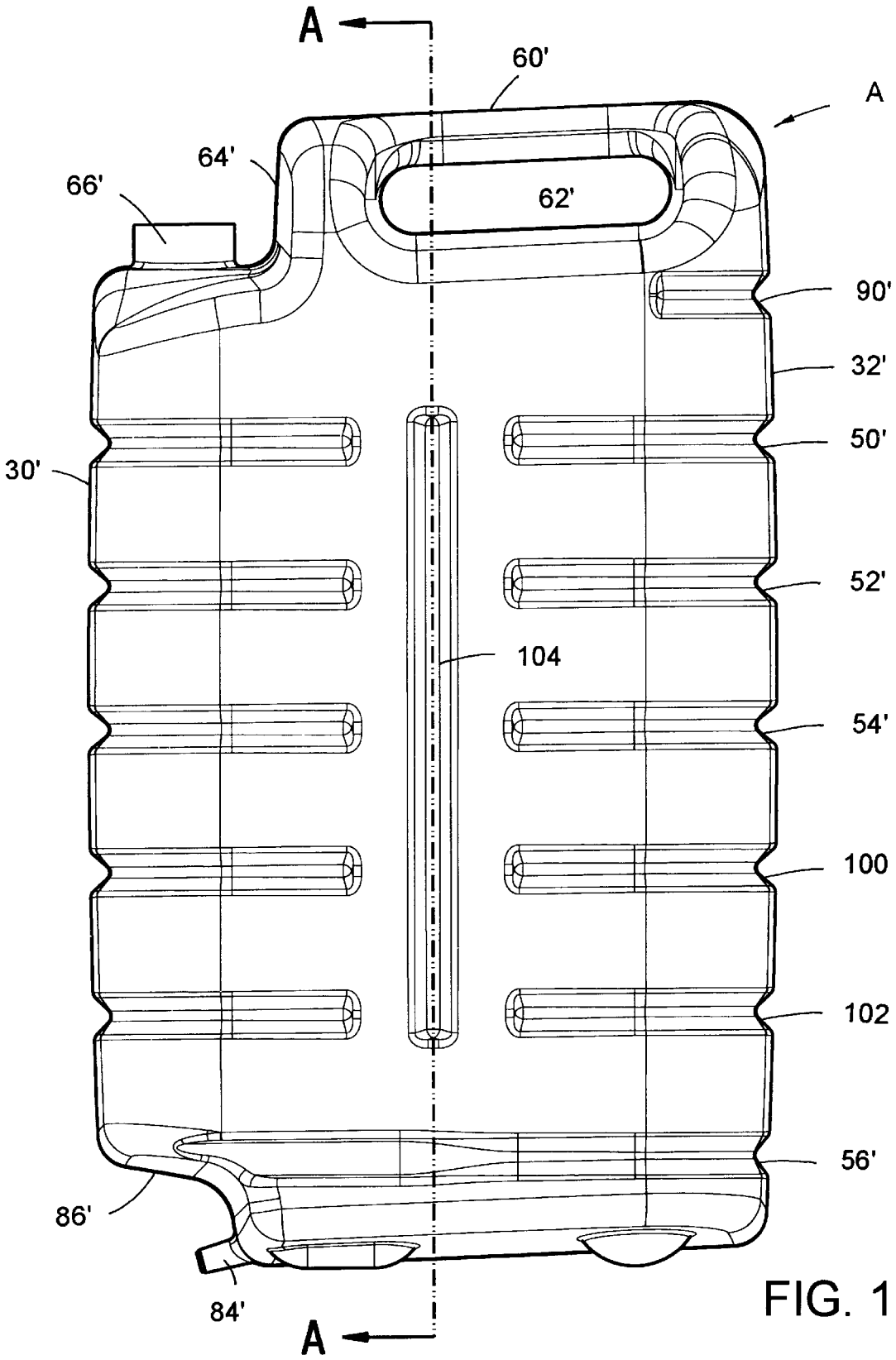
FIG. 11 is a right side elevational view thereof, the left side elevational view being a substantial mirror image thereof.
Figure 12:
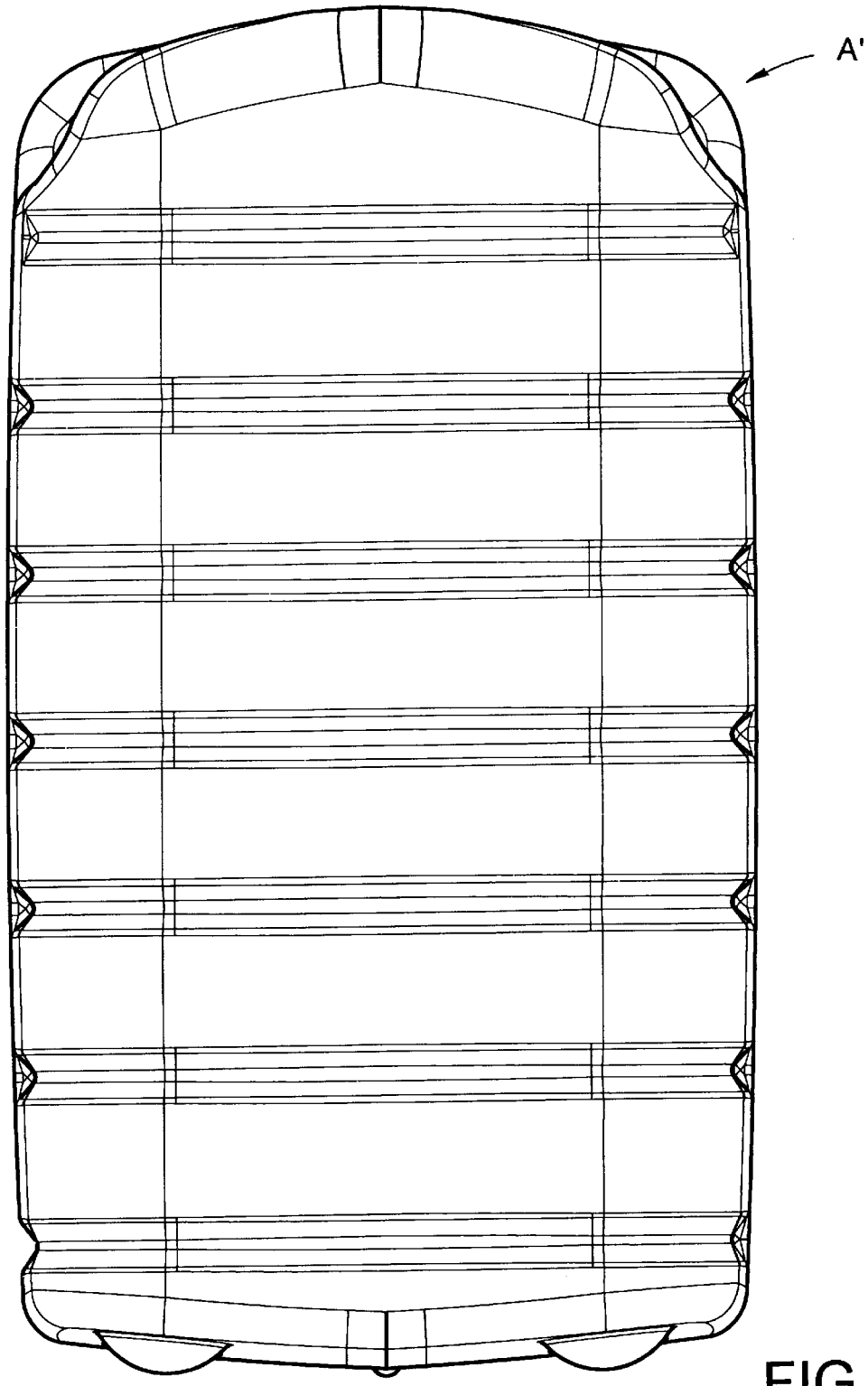
FIG. 12 is a rear elevational view thereof.
Figure 13:
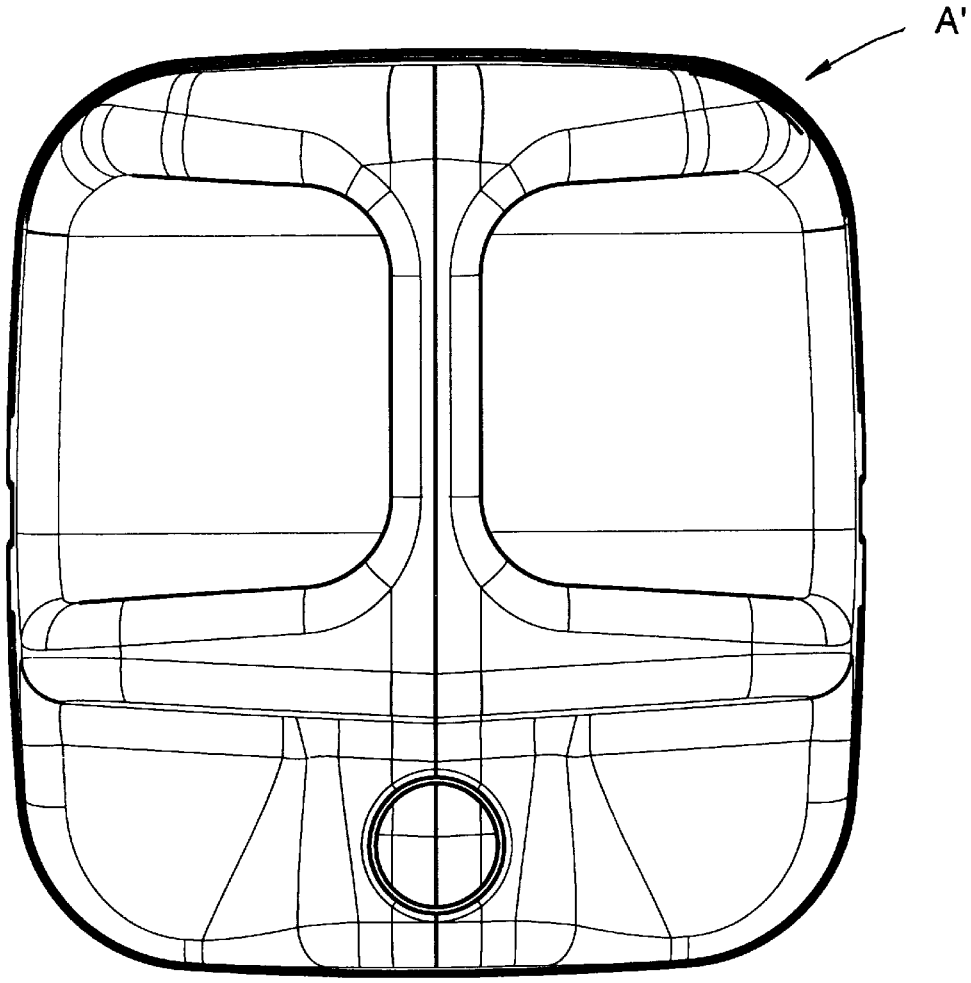
FIG. 13 is a top plan view thereof.
Figure 14:
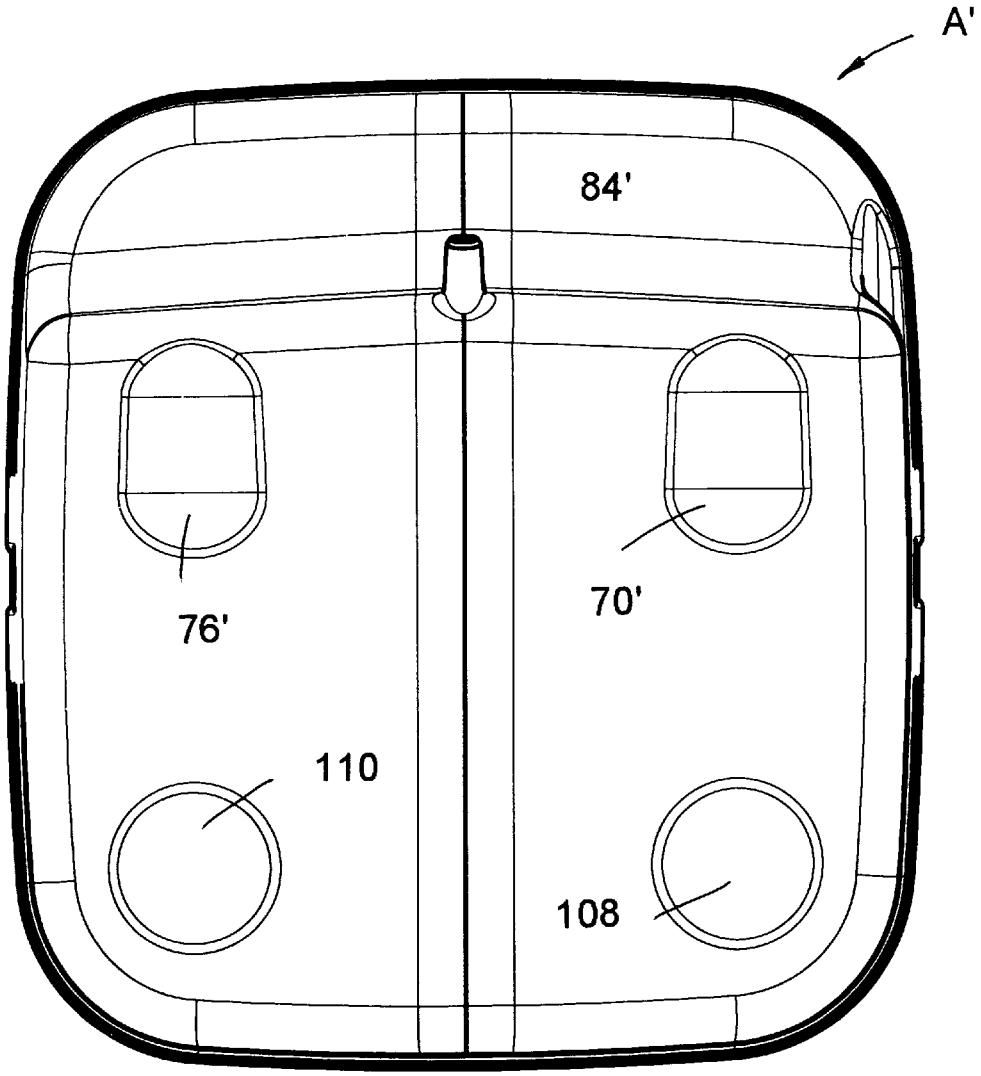
FIG. 14 is a bottom plan view thereof.
Figure 15:
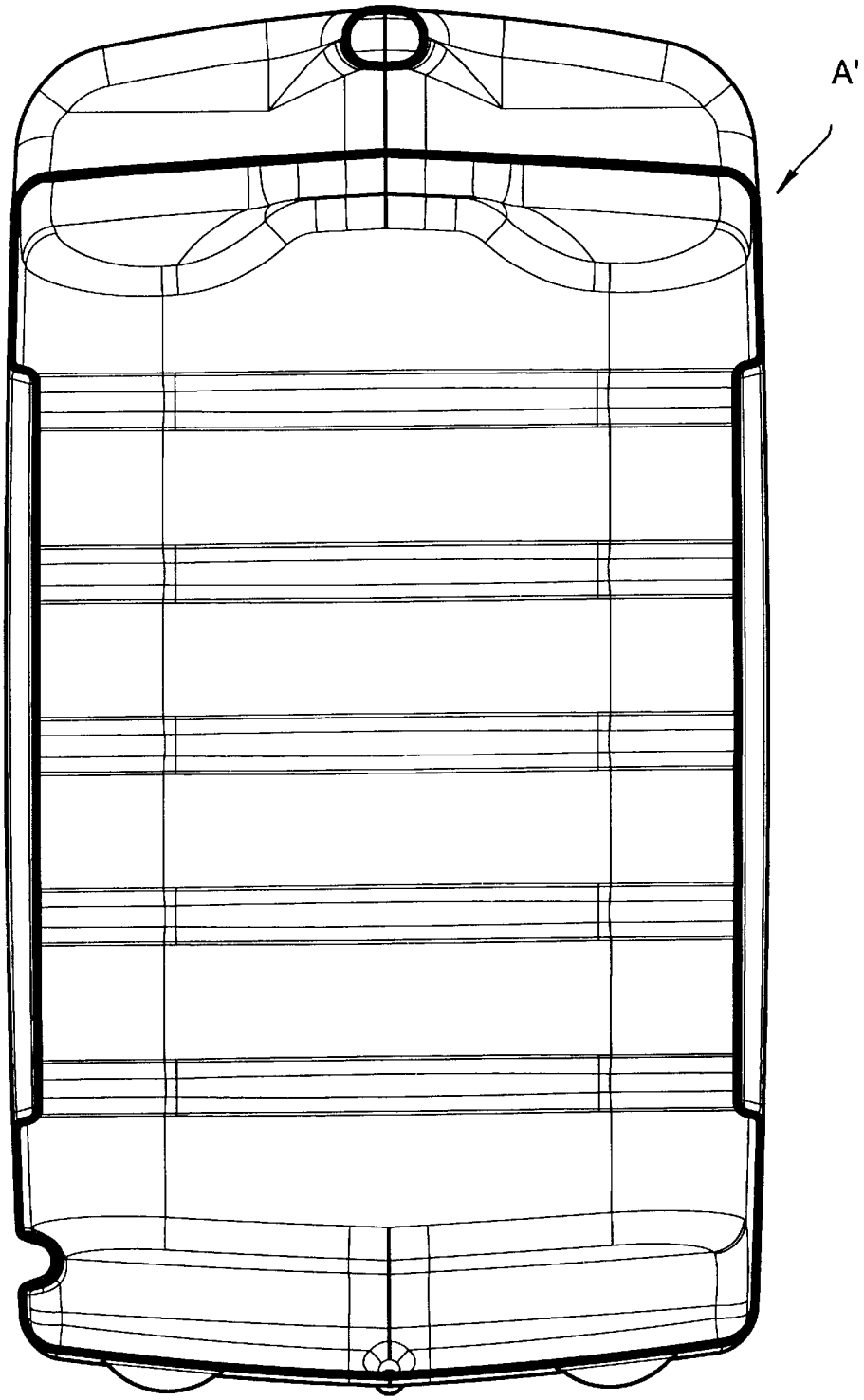
FIG. 15 is a cross-sectional view taken generally along the lines A—A of FIG. 11.
Figure 16:
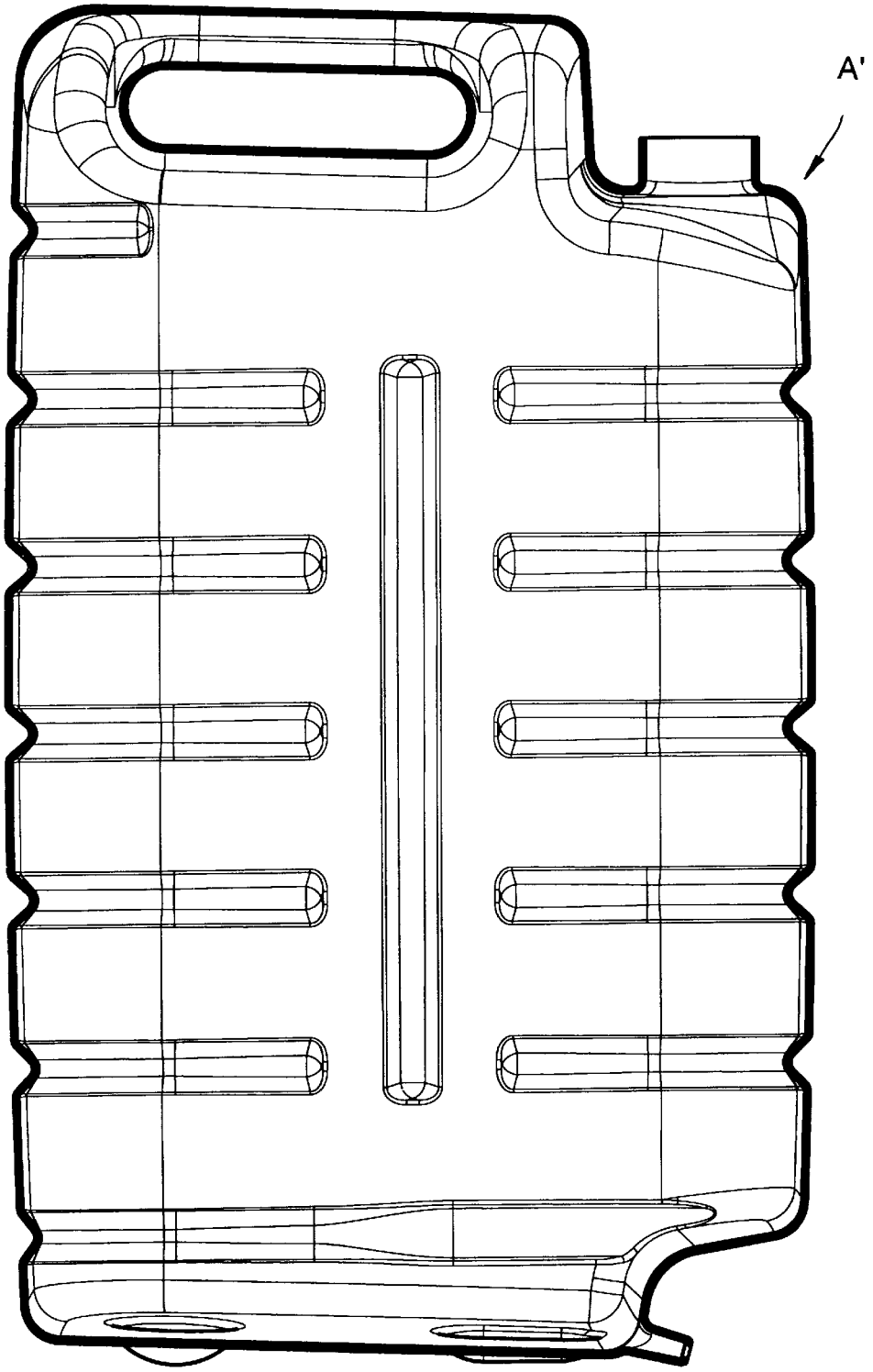
FIG. 16 is a cross-sectional view taken generally along the lines B—B of FIG. 10.
Figure 17:
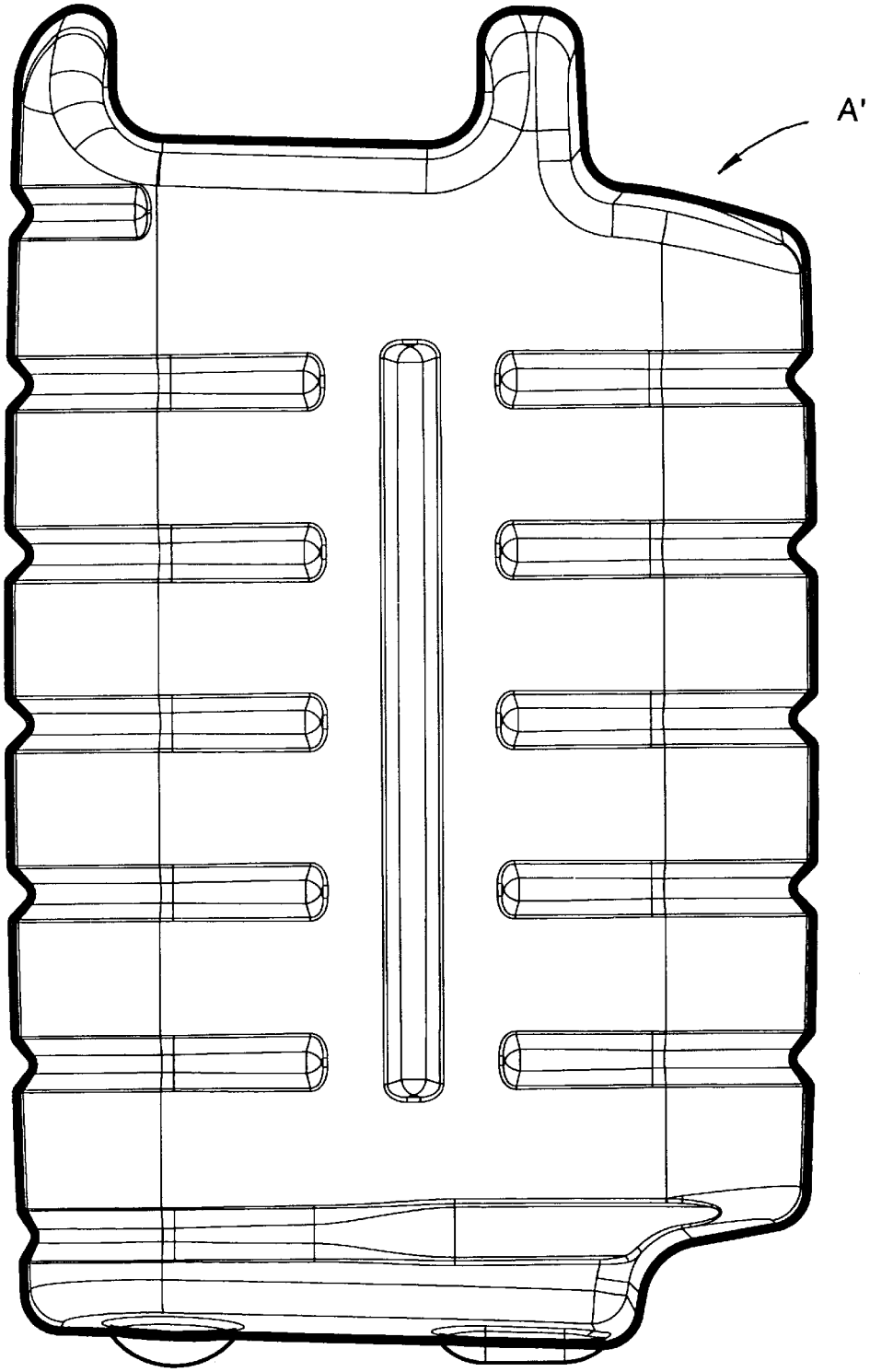
FIG. 17 is a cross-sectional view taken generally along the lines D—D of FIG. 10.
Figure 18:
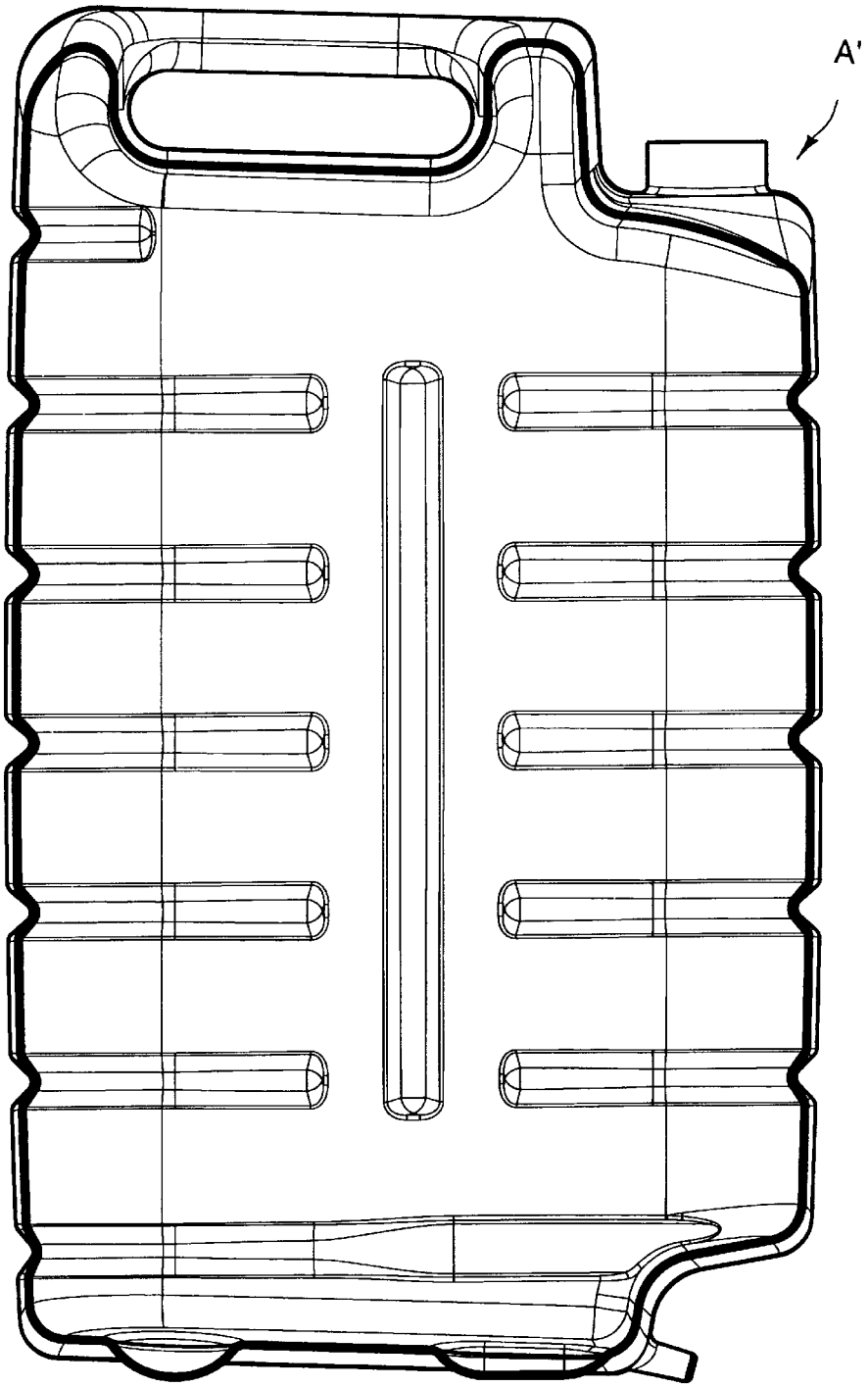
FIG. 18 is a cross-sectional view taken generally along the lines E—E of FIG. 10.
Figure 19:
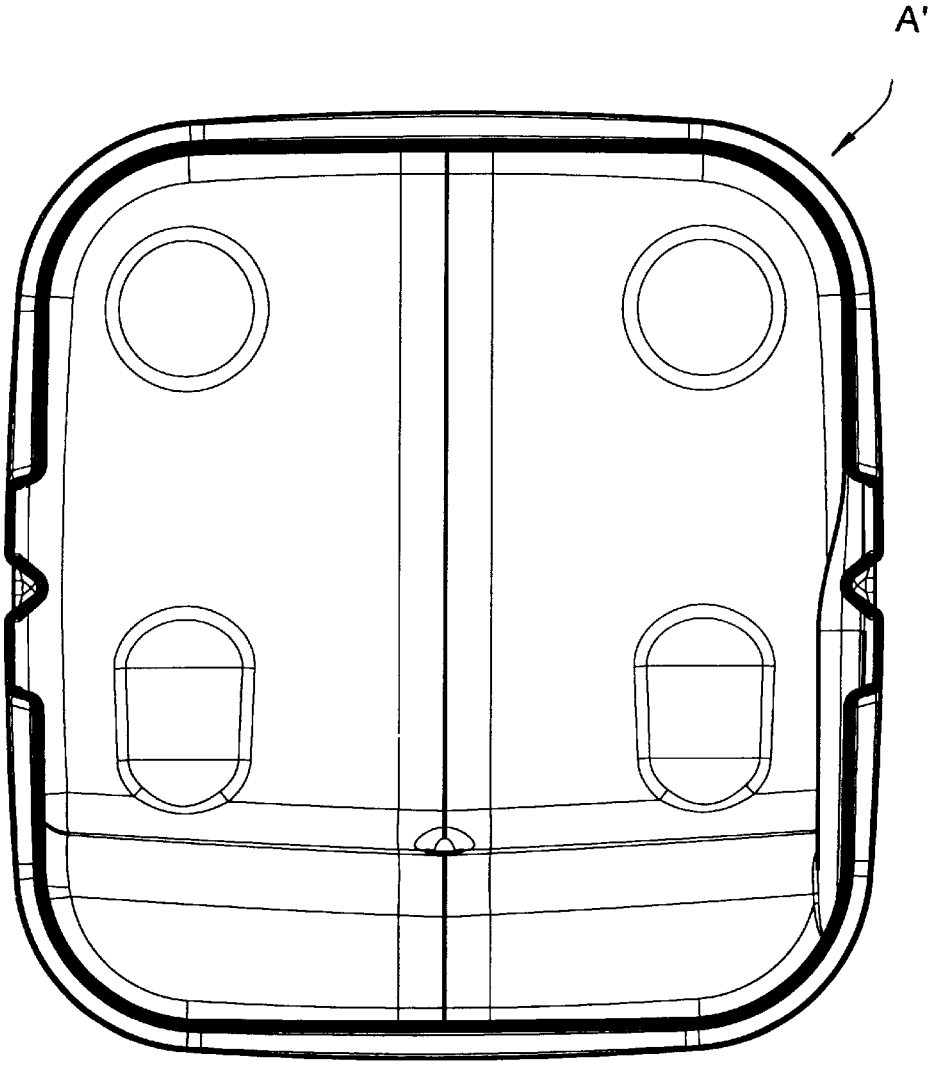
FIG. 19 is a cross-sectional view taken generally along the lines C—C of FIG. 10.

In addition, and as illustrated in FIG. 6, the bottom surface has a slight V-shaped conformation or slope from side to side (FIG. 1). Portions 80, 82 extend from the respective sidewalls 34, 36. Each portion tapers downwardly from the respective sidewall intersecting at a generally centrally-running valley, which also tapers back-to-front toward the second or dispensing opening 84. Thus, the dual incline or sloped arrangement as described urges the fluid from the container.

The dispensing opening is preferably formed in a recess 86 that extends upwardly from the bottom wall and inwardly from the front wall 30. The recess 86 is intended to allow easy container dispensing, even when disposed in stacked relation as shown in FIG. 7. Neither the vent opening 66 nor the dispensing opening 84 of adjacent containers overlap or obstruct the other's use in the preferred arrangement.

As illustrated in FIGS. 2, 3, and 6, the rear wall 32 may include an additional rib section 90. Here, the strengthening rib extends over only the rear wall, again, to strengthen and rigidify the rear wall so as to transfer forces from the upper surface 30 to the lower surface 40.

In addition, the lowermost rib 56 has a slightly modified or tapered entry, defining an inlet channel 92 (FIG. 3)to the remainder of the rib. At the terminal end of the rib 92 adjacent the dispensing opening 84, the V-shaped walls defining the inwardly extending rib spread open or diverge from one another to receive a flexible dispensing hose 94 therein. Thus, the lowermost rib 56 serves the dual function of strengthening and rigidifying the container structure, while also serving as a storage means or storage recess area for the flexible tubing associated with the dispensing opening 84.

The stacked relationship of dispensing containers is best shown in FIG. 7. The upper surface of the lower container supports the individual feet extending from the next adjacent upper container. Vertical forces are transferred generally evenly over the upper surface and, in addition, the bridging handle 60 provides added strength and rigidity between the parallel portions of the H-shaped top wall. The vertical forces are transferred down the side walls and the front and rear walls to the base or bottom. The strengthening ribs are removed from the illustration of FIG. 7 for simplification only and it will be recognized that the ribs serve a crucial function in the transfer of the vertical forces. The recesses 64, 86 are both located adjacent the front wall 30 of the respective containers so that adequate space is provided for manipulating the vent opening 66, as well as the dispensing opening 84 and the flexible tubing associated therewith.

FIGS. 8–19 illustrate a second preferred embodiment of a caseless dispenser container, shown as a five (5) gallon container. Where possible, like numerals refer to like elements and new numerals refer to new elements. Generally, the overall structure and function is the same of the containers is the same. That is, a series of generally parallel ribs are disposed substantially continuously about the periphery of the sidewalls and front and rear walls. Because of the increased size or capacity of this container, an additional one or two strengthening ribs 100, 102 are required.

The ribs in this embodiment are also slightly different than those described with reference to FIGS. 1–7. In the second embodiment, the ribs are defined by generally U-shaped portions that do not extend about the entire periphery of the container, but do extend about substantially the entire periphery of the container. Thus, for purposes of this discussion, a rib may be defined by first and second U-shaped sections denoted by a, b. Terminal ends of these rib portions are defined in the sidewalls and are spaced adjacent an additional, vertically oriented rib 104. Again, this illustrates that the structural ribs need not adopt a predetermined configuration, but rather must be capable of effectively transferring forces from the upper wall to the base surface.

The fill/vent opening is also disposed on a raised land 106 in the recess 64' of the top surface 38'. Again, the venting structure (FIG. 10) preferably does not extend beyond the upper surface so that the vent is operable when the containers are in stacked relation.

Another modification from the embodiment of FIGS. 1–8 is that the feet have slightly different conformations. Here, the feet disposed most closely adjacent the front wall, i.e., 70', 76' are still of an elongated, oval configuration. The pair of feet 108, 110 disposed adjacent the rear wall, however, have a hemispherical or rounded configuration. The location of the feet at spaced regions that coincide with the substantially planar, parallel regions of the H-shaped top surface advantageously transfers the vertical forces from one container to another disposed in stacked relation.

The second preferred embodiment also adopts the dual taper or slope (i.e. from side to side by portions 80', 82', and the rear to front taper by the sloping bottom wall) provided in the bottom of the cavity so that fluid is effectively drained from the cavity and toward the dispensing opening 84'. This is best illustrated in FIGS. 10, 12 and 15–18.

Moreover, the dual function of the lowermost rib is retained in the second preferred embodiment. That is, the terminal end of the lowermost rib diverges open to receive the flexible hose that is connected at one end to the dispensing opening 84' and is squeezed between the sidewall that define the rib during storage.

Figure 20:
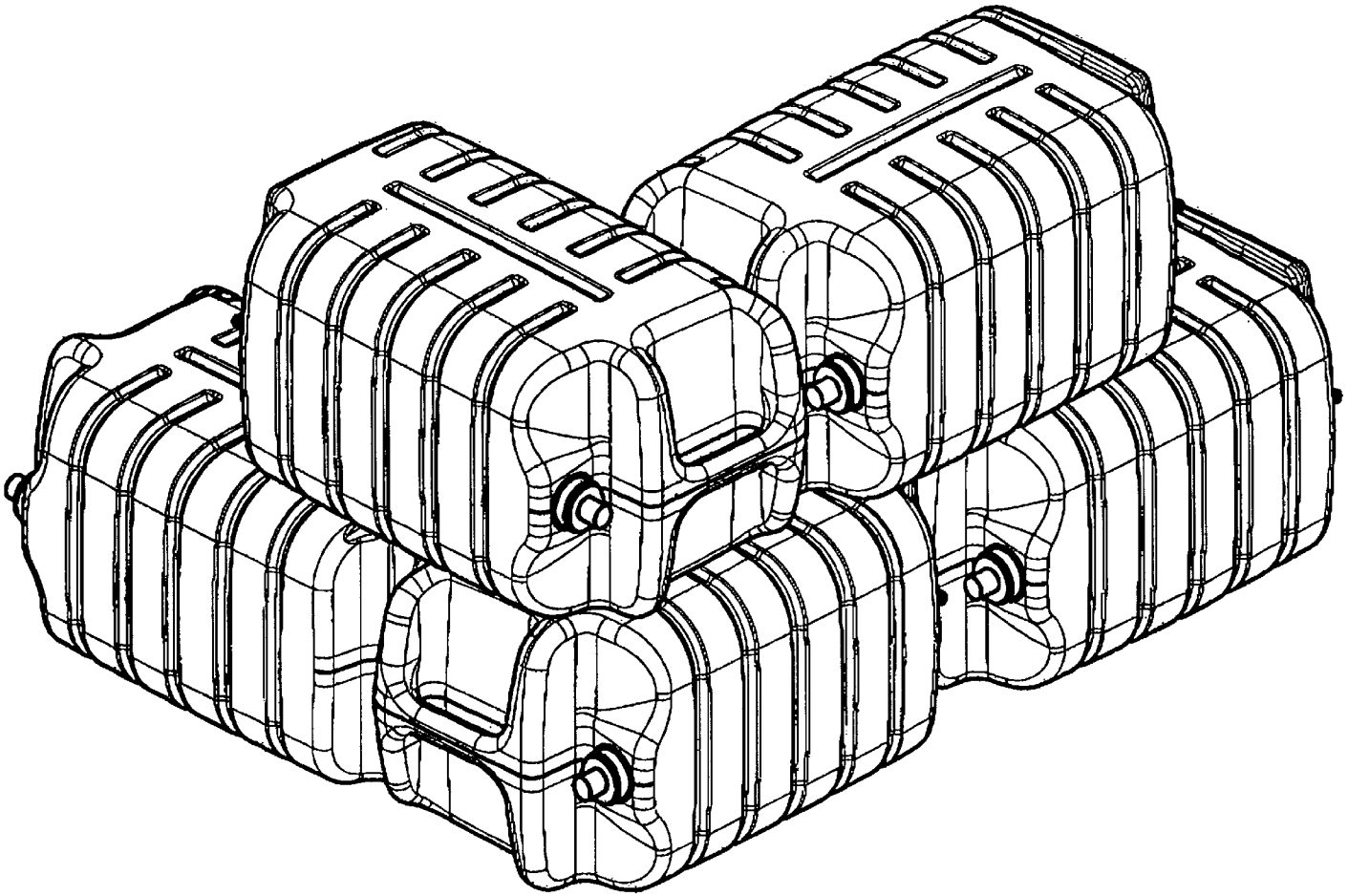
FIG. 20 is a perspective view of the inventive containers in a preferred stacking relation.

FIG. 20 illustrates one preferred conformation of stacking the containers one atop the other. As shown, the containers are disposed in horizontal relation so that the strengthening ribs are oriented in vertical fashion. Moreover, the containers are arranged end to end on one level and then offset and arranged end to end on the next adjacent level. This provides a stable stacked array that advantageously transfers the vertical loads from one level to the other and ultimately to a supporting pallet or surface (not shown).

The invention has been described with reference to the preferred embodiments. Obviously, modifications and alterations will occur to others upon a reading and understanding of this specification. It is intended to include these modifications and alterations insofar as they come within the scope of the appended claims or the equivalents thereof.

Having thus described the invention, it is now claimed:

1. A container adapted for storing and dispensing fluid products, the container comprising:

a generally parallelepiped housing having a base, top wall, front and back walls, and side walls enclosing a hollow, fluid cavity;

an integrally formed handle in the container having a recess adapted to receive a user's fingers therein for grasping the container and including a planar upper surface dimensioned to support an adjacent container thereon;

a first, fill opening disposed in the top wall for filling the cavity with fluid and venting the cavity during dispensing;

a second, dispensing opening provided adjacent the bottom wall having a spout that faces the front wall and through which fluid is dispensed; and at least one structural support rib provided on the side walls for adding strength to the container allowing the containers to be stacked one atop another.

2. The container of claim 1 further comprising an inclined lower surface sloping toward the dispensing opening for draining fluid from the cavity when the container is disposed on a generally horizontal surface.

3. The container of claim 1 wherein the top surface is recessed to provide clearance for the fill opening.

4. The container of claim 1 wherein the structural support rib includes a tube storage slot for holding a tube received on the dispensing opening.

5. The container of claim 1 wherein the structural support rib extends in generally parallel fashion to the top surface and the base.

6. The container of claim 5 wherein the structural support rib includes plural ribs disposed in generally parallel relation and defined by inwardly protruding slots in the side walls of the container.

7. The container of claim 1 wherein the base includes a clearance for accommodating the dispensing opening therein.

8. The container of claim 1 further comprising domed feet extending form spaced regions in the base for elevating the base above an associated support surface.

9. The container of claim 1 wherein at least first and second domed feet have an elongated configuration for increasing the support area over which vertical loads may be transferred from one container to another when disposed in stacked relation.

10. A fluid container comprising:

a housing including four walls disposed in parallel pairs, and a top wall and a base enclosing upper and lower regions of the housing to define a cavity;

a handle in the top wall for grasping the container and including a generally planar upper surface dimensioned to support an adjacent container thereon;

a fill opening disposed in the top wall for filling the cavity with fluid and venting the cavity during dispensing;

a dispensing opening provided adjacent the bottom wall having a spout that faces the front wall and through which fluid is dispensed; and a series of strengthening ribs provided on the container for adding strength thereto and allowing the containers to be stacked one atop another, the ribs being disposed in generally parallel relation about substantially the entire periphery of the container.

11. The container of claim 10 further comprising an inclined lower surface sloping toward the dispensing opening for draining fluid from the cavity when the container is disposed on a generally horizontal surface.

12. The container of claim 10 wherein the top surface is recessed to provide clearance for the fill opening.

13. The container of claim 10 wherein the structural support rib includes a tube storage slot for holding a tube received on the dispensing opening.

14. The container of claim 10 wherein the base includes first and second tapers, the first taper extending generally from the rear to the front and the second taper extending generally inward from each sidewall to improve drainage of the cavity.

* * * * *